United States Patent [19]

Yonemoto et al.

[11] 4,337,846

[45] Jul. 6, 1982

[54] ELEVATOR RELEVELLING CONTROL APPARATUS

[75] Inventors: Masashi Yonemoto; Eiki Watanabe, both of Inazawa, Japan

[73] Assignee: Mitsubishi Denki Kabushiki Kaisha, Tokyo, Japan

[21] Appl. No.: 142,808

[22] Filed: Apr. 22, 1980

[30] Foreign Application Priority Data

Apr. 24, 1979 [JP] Japan ..... 54/50494

[51] Int. Cl.[3] ..... B66B 1/44

[52] U.S. Cl. ..... 187/29 R

[58] Field of Search ..... 187/29

[56] References Cited

U.S. PATENT DOCUMENTS

| | | | |
|---|---|---|---|
| 2,847,091 | 8/1958 | Santini et al. | 187/29 |
| 3,587,785 | 6/1971 | Krauer et al. | 187/29 |
| 3,741,348 | 6/1973 | Caputo | 187/29 |
| 4,071,116 | 1/1978 | Halperin et al. | 187/29 |
| 4,094,385 | 6/1978 | Maeda et al. | 187/29 |
| 4,114,731 | 9/1978 | Faup et al. | 187/29 |

*Primary Examiner*—Gene Z. Rubinson
*Assistant Examiner*—W. E. Duncanson, Jr.
*Attorney, Agent, or Firm*—Sughrue, Mion, Zinn, Macpeak & Seas

[57] ABSTRACT

An elevator relevelling control apparatus for controlling the movement of an elevator car (11) such that when the car is misaligned with the landing position of a selected landing floor, the car is restarted and brought into alignment. A traction motor (M) is controlled by a landing means (1) which generates a speed command signal (1*a*) of a magnitude which increases linearly with the extent of misalignment. First and second position detecting devices (15, 16, 17, 18) are provided in the hoistway to detect misalignment from the landing position by a first or second predetermined distance, respectively. The car is provided with load detecting means (12) for detecting whether or not the car is overloaded. If the load detecting means (12) detects that the car is not overloaded, and a switching device (15, 16) detects that the car is misaligned by a first predetermined distance, a speed command signal (1*a*) of suitable magnitude is supplied to the traction motor (M), thereby effecting relevelling. If, on the other hand, the car is detected to be in an overloaded state, and a switching device (17, 18) detects that the car is misaligned by a second, greater, predetermined distance, a speed command signal of larger magnitude is supplied to the traction motor (M), whereby the relevelling operation can be commenced with a torque greater than that applied when the car is not overloaded.

15 Claims, 4 Drawing Figures

FIG 1
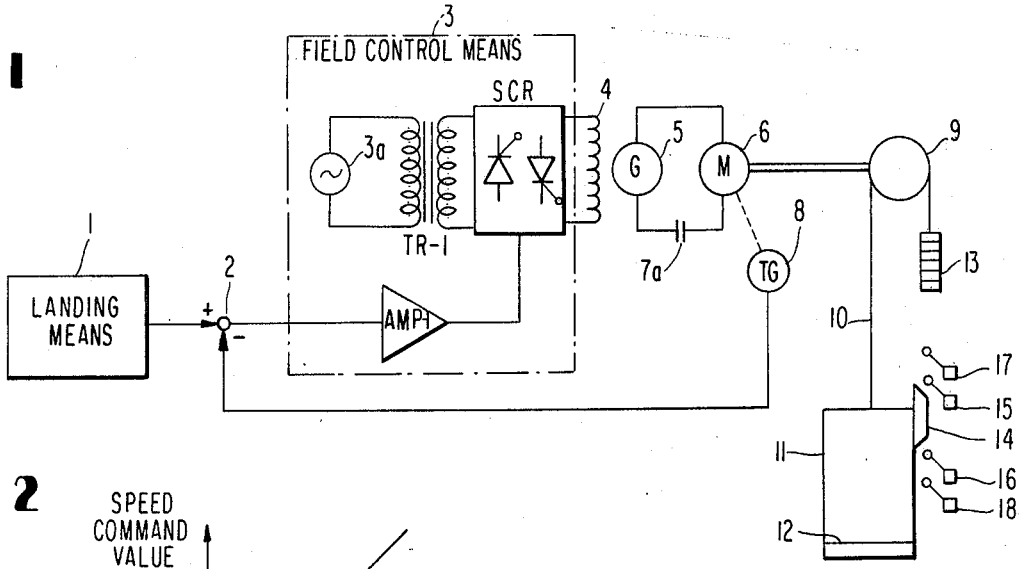
FIG 2
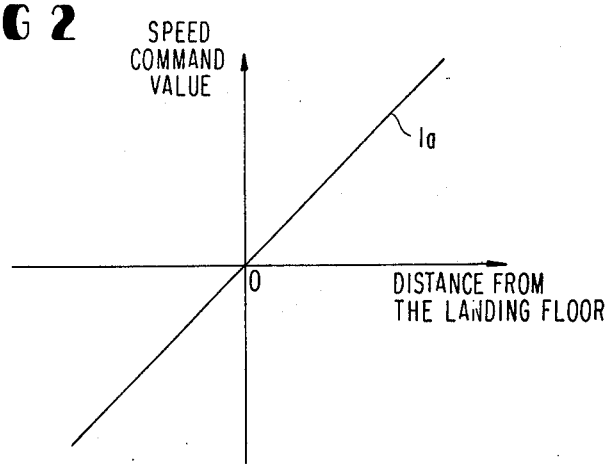
FIG 3
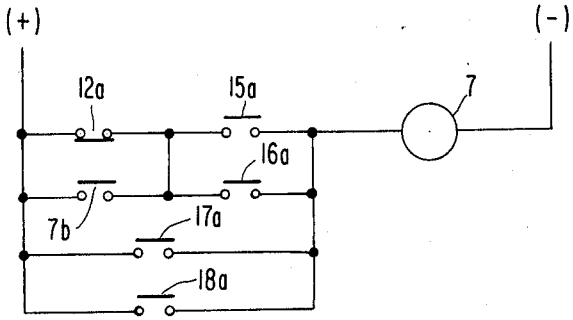
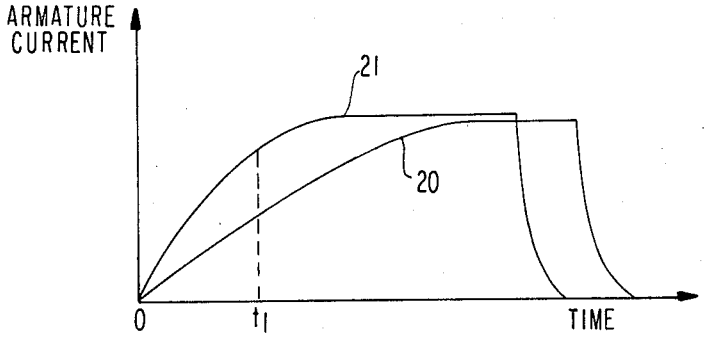
FIG 4

ELEVATOR RELEVELLING CONTROL APPARATUS

BACKGROUND OF THE INVENTION

1. Field of the Invention:

This invention relates to improvements in apparatus for controlling the relevelling of an elevator car.

2. Description of the Prior Art:

An elevator car is normally suspended from a main rope, or cable, and moves vertically in a hoistway. When the vertical travel of the car is considerable, the amount of stretching of the main rope varies considerably, according to the load in the car. This is particularly obvious in the case of high rise and super high rise buildings, where the rope is necessarily long and the load applied to it varies considerably with the loading and unloading of passengers. Accordingly, as the load in the car varies after the car has arrived at a floor and stopped, and the main rope is maintained by a brake, the car may move up or down, such that any step between the car floor and the building floor increases to the point that it may eventually go beyond the permitted landing error (hereinbelow referred to as "landing error"). In such circumstances, in order to place the car back within the landing error, the brake is released, and the car is moved in a direction opposite to the aforementioned movement up or down. This is called "relevelling".

As is generally known, relevelling is carried out with both the car and the landing doors open, so the domain in which relevelling is possible is, from the point of view of safety, necessarily narrow. Also, if the attempt at relevelling fails, and the car moves beyond a predetermined distance from the landing floor, the car must immediately be restrained.

Immediately after the brake has been released for the purpose of relevelling, there is a tendency for the extent of movement (extent of misalignment with the landing floor) of the car to increase due to the weight difference between the car and its counterweight. In an elevator which has a torque balancing means, whereby the load in the car is detected prior to starting up the car, and an armature current is caused to flow which offsets the unbalancing torque which arises from the weight difference between the car and the counterweight, the extent of movement is comparatively small. However, in an elevator without a torque balancing means, the extent of movement is quite large, and particularly when the car is overloaded, this can be marked to the extent that the car may fall below the domain in which relevelling is possible. Also, if for some reason the brake is unable to produce a sufficient arresting force to support the overload, once the car has gone beyond the domain in which relevelling is possible, the means for maintaining the car are removed, and the car may slide downwards, which is very dangerous.

SUMMARY OF THE INVENTION

It is an object of the present invention to do away with the above mentioned defects, and to provide a means for controlling the relevelling of an elevator car, which, even in elevators without a torque balancing means, can reliably carry out relevelling with an overload, and which prevents the car from sliding downwards even when the brake does not produce sufficient arresting force.

It is another object of this invention to provide a means for controlling the relevelling of an elevator car which, when the load in the car exceeds a predetermined value, does not carry out relevelling when the car has reached a point beyond a first predetermined distance away from the landing floor at which relevelling is normally commenced, but which does carry out relevelling in accordance with the value of a landing speed command signal, which varies with the distance by which the car has gone out of alignment with the landing floor, when the car reaches a point distant from the floor by a second predetermined value, greater than said first predetermined value, whereby even when the load in the car is large, there is sufficient relevelling capability, and even when the arresting torque of the brake is inadequate, the car is fully prevented from sliding downwards.

BRIEF DESCRIPTION OF THE DRAWINGS

In the drawings:

FIG. 1 is a schematic diagram showing one embodiment of an elevator relevelling control means according to the invention;

FIG. 2 is an output characteristic curve of the landing means of FIG. 1;

FIG. 3 is a control circuit used in conjunction with the circuit of FIG. 1; and FIG. 4 shows the characteristic curves of the armature current at the time of relevelling.

DETAILED DESCRIPTION OF THE PREFERRED EMBODIMENT

Referring to FIG. 1, landing means 1, which may be similar to the hoistway transducer shown in FIG. 4A of U.S. Pat. No. 3,207,265, produces a landing speed command signal 1*a* as shown in FIG. 2. Comparator 2 produces an output signal representing the difference between the speed command signal 1*a* and a feedback or return speed signal 8*a*, which will be described later. A field control means 3 includes an AC power source 3*a*, a transformer TR-1, an amplifier AMP-1 and a circuit using thyristors SCR. A D.C. generator G has a field winding 4 and an armature 5, and an electric traction motor M (a field winding thereof not being shown) has an armature 6. Element 7*a* is a normally open contact of an electromagnetic contactor 7 which is used in the circuit shown in FIG. 3. Contact 7*a* is made to open and close upon the de-energization and energization of contact 7, respectively. The armature 6 drives a tachogenerator 8, which sends a signal 8*a*, corresponding to the car's speed, to comparator 2.

A main cable 10 is wound on the sheave 9 of a traction machine driven by armature 6, and to the respective ends of this cable are attached a car 11 and a counterweight 13. A load detecting means 12 is fitted in the floor of car 11, and is activated when the load in car 11 reaches a predetermined overload value.

A cam 14 is fitted on a side of car 11, and engages switching devices 15 and 16 provided in the hoistway at each landing floor. These switching devices constitute a first position detecting means, and determine a first zone of misalignment between the car and a landing floor. Similarly, switching devices 17 and 18 of a second position detecting means are respectively provided above and below switching devices 15 and 16 of the first position detecting means, and determine a second zone of misalignment between the car and a landing floor. Cam 14 has a length sufficient to engage the switching devices of both the first and second position detecting means, on the same respective side of a floor landing position, (15 and 17, or 16 and 18) at the same time. The respective switching devices of the first and second position detecting means, 15, 16 and 17, 18, are disposed in a hoistway with a vertically symmetrical relationship on the basis of an appropriate landing position of the car. This disposition is the same at each floor.

Referring now to FIG. 3, the reference numeral 7 designates an electromagnetic contactor used in the main circuit, and element 7*b* is a normally open contact thereof, which is automatically closed upon energization of the contactor 7, and again opened upon the de-energization thereof. Reference numeral 12*a* designates a normally closed contact of the load detecting means 12 of FIG. 1, and 15*a* to 18*a* are the respective normally open contacts of the switching devices 15 to 18 of the position detecting means.

Referring to FIG. 4, reference numeral 20 indicates the curve of the current supplied to armature 6 when relevelling is activated by a switching device, 15 or 16, of the first position detecting means, and 21 indicates the curve of the current supplied to armature 6 when relevelling is activated by a switching device, 17 or 18, of the second position detecting means.

In operation, when the car 11 stops within the normal landing error, the cam 14 does not engage either of the switching devices 15, 16 of the first position detecting means. If the load in the car has not reached the overload value, the load detection means contact 12*a* remains closed.

If the car 11 subsequently moves in a downward direction due to the stretching of the main cable 10, etc., the cam 14 will engage the switching device 16 of the first position detecting means, and contact 16*a* will be closed. Then, by the circuit (+); l2*a*; 16*a*; 7; (−), the electromagnetic contactor 7 is energized, and is maintained in this state by the closing of the self holding contact 7*b*. At the same time, contact 7*a* is made to close.

As shown in FIG. 2, landing means 1 generates a landing speed command signal 1*a*, the value of which varies in accordance with the distance from the landing floor, which is applied to field control means 3 through comparator 2. The field winding 4 of generator 5 is controlled by the output signal of field control means 3, and the voltage applied to armature 6 is controlled by a well known conventional device. Thus, the car 11 is made to move in an upward direction. The curve 20 of the armature current at this time is as shown in FIG. 4. Time $t_1$ is the point at which the brake (not shown) is released. Concurrently with the movement of car 11, a speed signal 8*a* is generated by a tacho-generator 8, whereupon comparator 2 produces a signal proportional to the difference between the speed command signal 1*a* and the speed signal 8*a*, and the speed of armature 6 is automatically controlled, with high accuracy. When the cam 14 becomes disengaged from the switching device 16 of the first position detecting means due to the upward movement of the car, contact 16*a* is released, and electromagnetic contactor 7 is de-energized, and contact 7*a* is released, so that armature 6, which is to say car 11, stops. The foregoing represents the normal relevelling process. Where car 11 moves in an upward direction, and cam 14 engages with switching device 15 of the first position detecting means, car 11 will descend in accordance with the same process as in the foregoing, and when cam 14 disengages with said switching device 15, car 11 stops.

If the load in car 11 reaches a predetermined overload value, contact 12*a* of load detecting means 12 will be opened. Therefore, even if car 11 moves in a downward direction, and contact 16*a* is closed by contact between cam 14 and switching device 16 of the first position detecting means, the electromagnetic contactor 7 will not be energized, so the relevelling operation will not be commenced. If, however, car 11 moves further in the downward direction and cam 14 engages with switching device 18 of the second position detecting means, contact 18*a* will be closed. Thereupon, the electromagnetic contactor 7 will be energized by the circuit (+); 18*a*; 7; (−), and relevelling will commence as described above. As is well known the response of control loop varies according to time constant and magnitude of a command signal. Since in this case the landing speed command signal 1*a* is greater than that when activated by the first position detecting means, although the time constant of the control loop is the same, the absolute values of the armature current at the time $t_1$ the brake is released are, as shown in curve 21 in FIG. 4, larger than that shown in curve 20. Thus, the relevelling operation is commenced with a large amount of torque, and the amount by which car 11 moves out of alignment with the landing floor when the brake is released is very slight. Thus, there is no fear that the car will go too far down such that cam 14 disengages with switching device 18 of the second position detecting means, making relevelling impossible.

Thus, the relevelling operation in the overload situation is commenced with the actuation of the second position detecting means, and car 11 moves in an upward direction. When cam 14 becomes disengaged from switching device 18 contact 18*a* is opened, but since, as stated above, cam 14 is of sufficient length to engage the switching devices,16 and 18, of both the first and second position detecting means, simultaneously, electromagnetic contactor 7 is maintained in an energized state by the circuit (+); 7*b*; 16*a*; 7; (−), and car 11 continues to move in an upward direction. Then when cam 14 becomes disengaged from switching device 16 of the first position detecting means, car 11 stops. If car 11 moves in an upward direction and relevelling is to be carried out in a downward direction, the operation proceeds in a similar manner.

Accordingly , even in a condition where the brake does not provide a sufficient arresting force to support an overload, it is possible to reliably cause car 11 to relevel without fear of going beyond the domain in which relevelling is possible, and so it is possible to prevent the dangerous situation where car 11 slides downward due to the inadequacy of the brake's arresting force.

Normal operation of the car 11 after relevelling may commence with the closing of a switch (not shown) which is connected to the contact 7*a* in parallel and is controlled by a generally known normal operation signal for the car.

It is understood that the above description is intended as illustrative rather than restrictive, and that variations and/or modifications may be made without departing from the spirit of the present invention.

What is claimed is:

1. An elevator relevelling control apparatus for causing an elevator car to restart when it has landed out of alignment with a landing floor at which it was required to land, comprising;

first position detecting means for detecting that said car has landed out of alignment with said landing floor position by a first predetermined distance, second position detecting means for detecting that said car has landed out of alignment with said landing floor position by a second predetermined distance greater than said first predetermined distance, landing means for generating a landing speed command signal, the value of which varies with the distance by which said car is out of alignment with said landing floor position, load detecting means for detecting whether the load in said car has exceeded a predetermined value, and means responsive to said landing speed command signal for relevelling said car when positional misalignment of said car has been detected by said first position detecting means when said load detecting means has detected that the load in said car does not exceed a predetermined value, and for relevelling said car when a positional misalignment of said car has been detected by said second position detecting means when said load detecting means has detected that said load in said car exceeds a predetermined value.

2. An elevator relevelling control apparatus as defined in claim 1, wherein said first position detecting means comprises at least two switching devices, and said car is provided with means for engaging said switching devices.

3. An elevator relevelling control apparatus as defined in claim 2, wherein said switching devices of said first position detecting means are provided in a hoistway with a vertically symmetrical relationship defining therebetween an appropriate landing position for said car.

4. An elevator relevelling control apparatus as defined in claim 1, wherein said second position detecting means comprises at least two switching devices, and said car is provided with means for engaging said switching devices.

5. An elevator relevelling control apparatus as defined in claim 4, wherein said switching devices of said second position detecting means are provided in a hoistway with a vertically symmetrical relationship, and on opposite sides of the switching devices of said first position detecting means.

6. An elevator relevelling control apparatus as defined in claim 2, wherein the length of the zone defined by the vertical distance between said switching devices of said first position detecting means is greater than the length of said engaging means.

7. The relevelling control means of claim 1, wherein said first position detecting means comprises at least two switching devices, said second position detecting means comprises at least two switching devices, and said car is provided with means for engaging at least one of said switching devices, the distance between a switching device of said first position detecting means and a switching device of said second position detecting means respectively disposed on the same side of a landing position being shorter than the length of said engaging means.

8. An elevator relevelling control apparatus for causing an elevator car to restart when it has landed out of alignment with a landing floor at which it was required to land, comprising;

first position detecting means comprising at least two switching devices which detect when said car is out of alignment with said landing floor position by a first predetermined distance from said landing position.

second position detecting means comprising at least two switching devices which detect when said car is out of alignment with said landing floor position by a second predetermined distance from said landing position, greater than said first predetermined distance, landing means for generating a landing speed command signal, the value of which varies with the distance by which said car is out of alignment with said landing floor position, load detecting means for detecting whether the load in said car has exceeded a predetermined value, and circuit means comprising a first electrical control circuit for activating the process of relevelling when at least one of said switching devices of said first position detecting means detects a positional misalignment of said car, and a second electrical control circuit which activates the process of relevelling when at least one of said switching devices of said second position detecting means detects a positional misalignment of said car, said first electrical control circuit being rendered inoperative when said load detecting means detects that said car is in an overloaded state.

9. An elevator relevelling control apparatus as defined in claim 8, wherein said load detecting means is installed in the platform of said car.

10. An elevator relevelling control apparatus as defined in claim 8, wherein said first electrical control circuit and said second electrical control circuit are connected in parallel.

11. An elevator relevelling control apparatus as defined in claim 10, wherein said circuit means further includes an electromagnetic contactor serially connected with said first and second electrical control circuits, said electromagnetic contactor having a normally open contact serially connected with a traction motor.

12. An elevator relevelling control apparatus as defined in claim 11, wherein said first electrical control circuit includes normally open contacts of said switching devices of said first position detecting means, said contacts being connected in parallel, and said second electrical control circuit includes normally open contacts of said switching devices of said second position detecting means, said contacts being connected in parallel.

13. An elevator relevelling control apparatus as defined in claim 12, wherein said first electrical control circuit further includes a contact of said load detecting means, said contact being normally closed, and being opened when the weight of the load exceeds a predetermined value.

14. An elevator relevelling control apparatus as defined in claim 13, wherein said contact of said load detecting means is serially connected with the contacts of said first position detecting means.

15. An elevator relevelling control apparatus as defined in claim 13, wherein said first electrical control circuit includes a self-holding contact of said electromagnetic contactor, said contact being connected in parallel with the contact of said load detecting means.

* * * * *